United States Patent [19]

Shinohara et al.

[11] Patent Number: 4,750,895

[45] Date of Patent: Jun. 14, 1988

[54] RECONFIGURABLE TOY ASSEMBLY

[75] Inventors: Muneyoshi Shinohara, Matsudo; Yoshio Suzuki, Koshigaya; Takashi Kunihiro, Abiko, all of Japan

[73] Assignee: Takara Co., Ltd., Tokyo, Japan

[21] Appl. No.: 49,704

[22] Filed: May 13, 1987

[30] Foreign Application Priority Data

Dec. 11, 1986 [JP] Japan ..... 61-295368

[51] Int. Cl.[4] ..... A63H 3/46; A63H 17/00

[52] U.S. Cl. ..... 446/230; 446/378; 446/465; 446/473; 446/487

[58] Field of Search ..... 446/230, 376, 378, 473, 446/465, 487

[56] References Cited

U.S. PATENT DOCUMENTS

| | | | |
|---|---|---|---|
| 4,580,993 | 4/1986 | Ohno | 446/376 |
| 4,583,958 | 4/1986 | Matsuda | 446/487 X |
| 4,586,911 | 5/1986 | Murakami | 446/376 |

FOREIGN PATENT DOCUMENTS

| | | | |
|---|---|---|---|
| 2559072 | 8/1985 | France | 446/97 |
| 2151149 | 7/1985 | United Kingdom | 446/97 |
| 2153242 | 8/1985 | United Kingdom | 446/99 |

*Primary Examiner*—Mickey Yu

*Attorney, Agent, or Firm*—Price, Gess & Ubell

[57] ABSTRACT

A reconfigurable toy assembly which is capable of transforming into six different forms, such as a robotic humanfold form, a gun form, a jet plane form, an automobile form, an armored car form and a puma form, by changing positions of movable toy components is disclosed. The toy assembly having a base member constituting a trunk portion of the robotic humanoid form, a robotic head member, a pair of arm members, a pair of leg members, a pair of front wing members, a pair of rear wing members, a pair of hand members and at least one head member of another form such as the puma form. When configured into one particular form, the toy assembly is capable of containing the components used for the other forms within the movable components used for the particular form.

5 Claims, 9 Drawing Sheets

RECONFIGURABLE TOY ASSEMBLY

BACKGROUND OF THE INVENTION

The present invention relates to a reconfigurable toy assembly and, more particularly, to a reconfigurable toy assembly which is capable of transforming into six different forms by changing the positions of movable toy components, and which is also capable, when configured into one particular form, of containing the components used for the other forms within the movable components used for the said particular form.

A conventional reconfigurable toy of this kind may be configured from one form into the other form by reassembling the movable components. However, there has been a desire for a more interesting reconfigurable toy which is capable of transforming into five, six or more forms. In such a reconfigurable toy, the number of movable components constituting a toy body is increased, and hence, when the reconfigurable toy is configured into one form, the components only used for the other forms hamper the transformation process and mar the external appearance of the reconfigurable toy.

Further, as the pivot movements of the components pivotally connected to the other components via pivot shafts may be restricted, a solution to this disadvantage has been desired.

SUMMARY OF THE INVENTION

Accordingly, it is an object of the present invention to provide a reconfigurable toy assembly, free from the aforementioned defects and disadvantages of the prior art, which is capable of transforming into six different forms by changing the positions of movable toy components, and which is also capable, when configured into one particular form, of containing the components used for the other forms within the movable components used for the said particular form.

In accordance with one aspect of the present invention, there is provided a reconfigurable toy assembly which is capable of transforming into six different forms by changing the positions of movable toy components, comprising a base member constituting a trunk portion of a robotic humanoid form of the reconfigurable toy assembly, a robotic head member pivotally mounted to the upper part of the base member so as to be retractable into the base member, a pair of arm members of the robotic humanoid form which are pivotally mounted to both the upper sides of the base member, a pair of collapsible leg members of the robotic humanoid form which are connected to the lower part of the base member, each leg member comprising a thigh member and a lower leg member which are pivotally connected to each other, and one member of which is contained within the other member and is convered by a cover member attached to the other member when folding the leg member, a pair of left and right front wing members of the robotic humanoid form which are pivotally mounted to the front left and right side portions of the base member, a pair of left and right bracket members which are pivotally mounted to the rear left and right side portions of the base member, a pair of left and right rear wing members of the robotic humanoid form which are pivotally mounted to the left and right bracket members, a pair of left and right accessory members which are pivotally mounted to the left and right leg members, a pair of left and right piece members which are pivotally mounted to the upper portions of the left and right arm members, a pair of left and right hand members of the robotic humanoid form which are rotatably mounted to the left and right arm members, and at least one head member of another form of the reconfigurable toy assembly which is so mounted to the rear portion of the base member as to be retractable into the base member.

In a preferred embodiment of the invention, each arm member is pivotally mounted to the base member via a crank coupling member, one end of which is pivotally mounted to the arm member and the other end of which is pivotally mounted to the base member.

Other and further objects, features and advantages of the present invention will appear more fully from the following description of the preferred embodiment thereof taken in connection with the accompanying drawings, in which:

DESCRIPTION OF THE PREFFERED EMBODIMENT

Figure 1A:
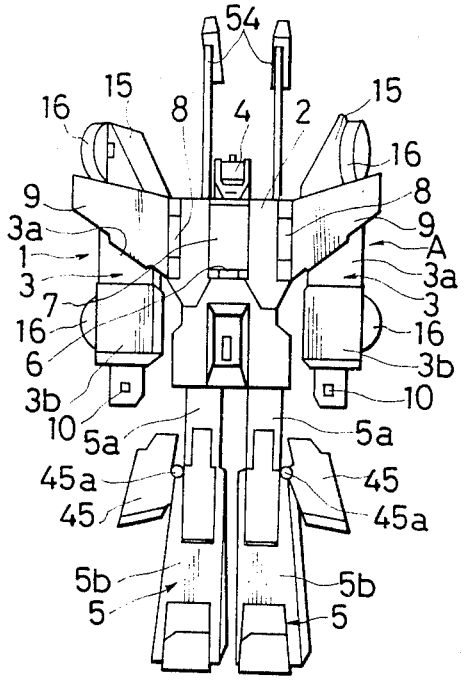
FIG. 1*a*–FIG. 1*f* show six different forms of a reconfigurable toy assembly according to the present invention.

Referring now to the drawings, wherein like reference numerals designate like or corresponding parts throughout the different views, there is shown in FIGS. 1*a*–1*f* a reconfigurable toy assembly A according to the present invention. This reconfigurable toy assembly A is consecutively transformed into six different forms, such as a robotic humanoid form, a gun form, a jet plane form, an automobile form, an armored car form and a puma form, as shown in FIGS. 1*a*–1*f*.

When a toy body 1 of the reconfigurable toy assembly A is configured into the robotic humanoid form, a pair of arm members 3 are pivotally mounted to both upper sides of a base member 2 constituting a trunk portion and a robotic head member 4 pivotally mounted to the central upper part of the base member 2 so as to be retractable into the base member 2. A pair of leg members 5 are slidably mounted to the lower part of the base member 2. A cover member 7 is pivotally mounted to the central front surface of the base member through a pivot shaft 6 and a pair of front wing members 9 are pivotally mounted to both the front side portions of the base member 2 through pivot shafts 8. In this case, by opening the cover member 7, the head member 4 may be retracted into the base member 2 by pivoting the head member 4. Since the arm members 3 are pivotally mounted to the base member 2, the base member 2 may preferably consist of two hollow divided members.

As shown in FIGS. 3a–3d, each arm member 3 comprises an upper arm member 3a, a forearm member 3b and a hand member 10. That is, the hand member 10 is rotatably mounted to the upper arm member 3a through a pivot shaft 11, and a rotary member 12 integrally having four stop claws 12a on its periphery at an equal interval is secured to the free end of the pivot shaft 11. The upper arm member 3a is provided with a flexible stop member 13 having approximately a U-shaped form with two stop grooves 13a in the lower part of the upper arm member 3a, and the stop claws 12a of the rotary member 12 are flexibly engaged with the stop grooves 13a of the stop members 13. Accordingly, the hand member 10 may be click-pivoted with respect to the upper arm member 3a.

Figure 3A:
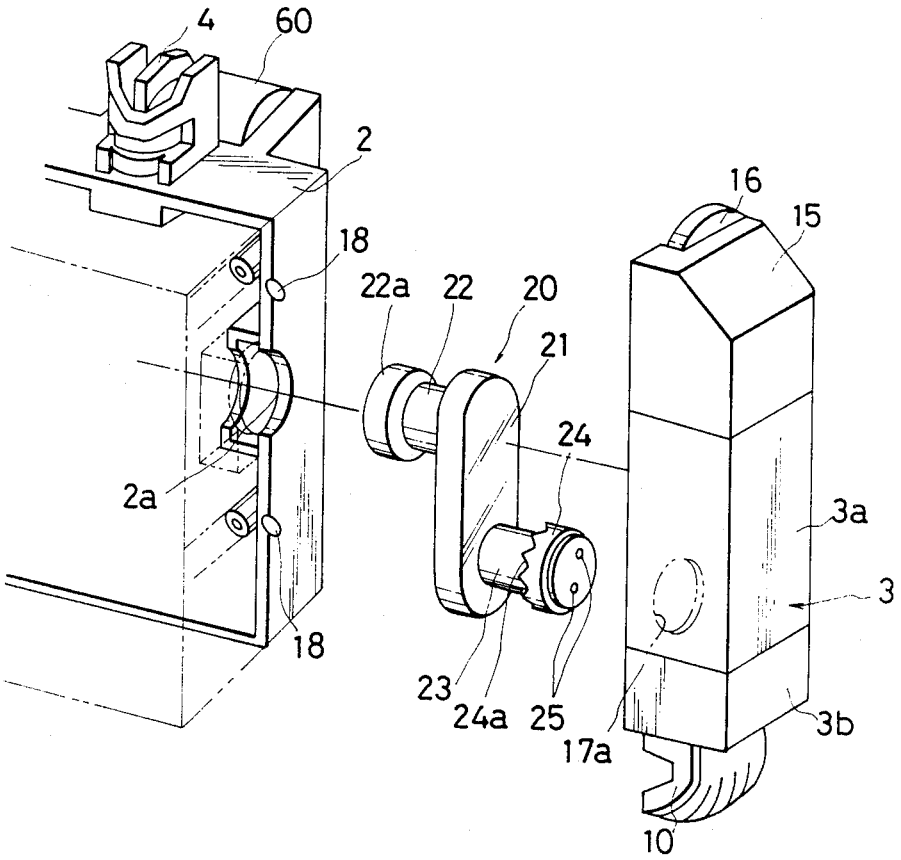
FIG. 3*a* is an exploded perspective view for explaining a connection between an arm and a base member of the robotic humanoid form.
Figure 3D:
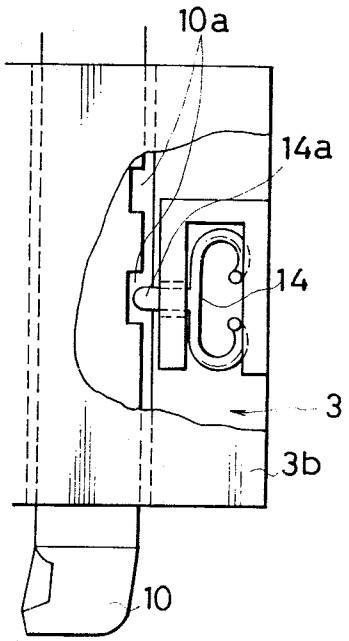
FIG. 3*b* is a side view, partly in section, for explaining the connected state between the arm and the base member shown in FIG. 3*a*, and FIG. 3*c* and FIG. 3*d* are perspective and side views for showing a connection of an upper arm, a forearm and a hand of the robotic humanoid form.
Figure 3C:
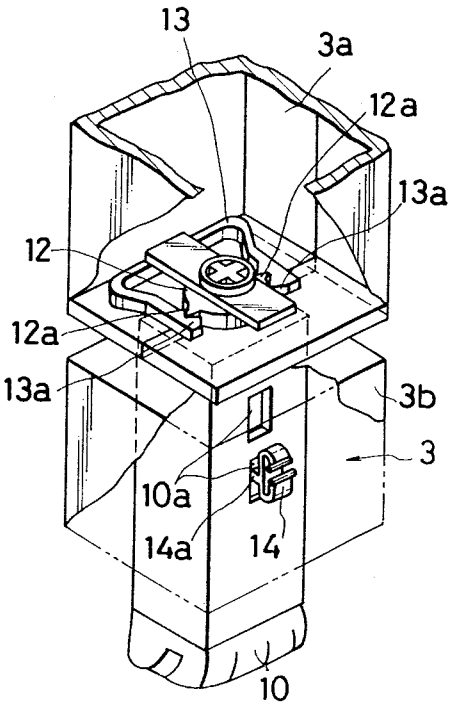
Figure 3B:
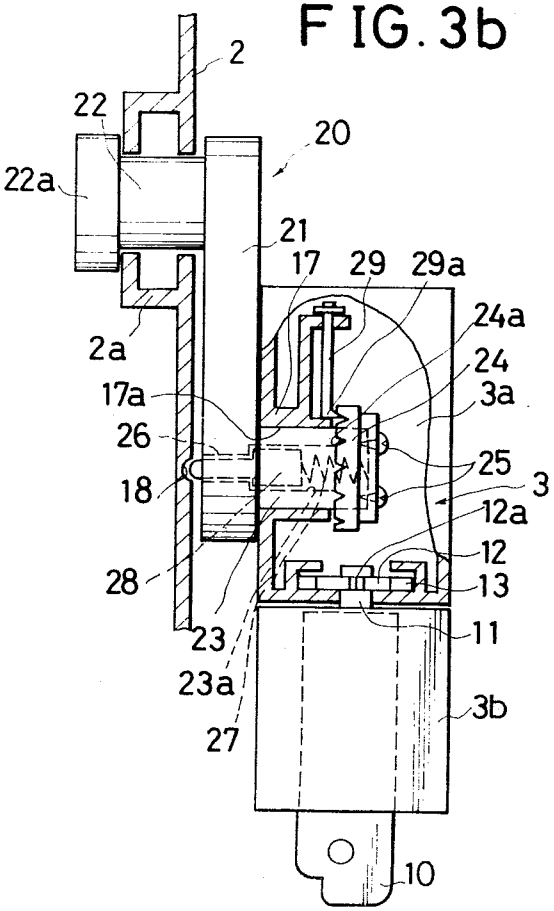

The forearm member 3b is slidably mounted on the hand member 10 so as to be movable along the hand member 10, and the forearm member 3b is provided with a flexible stop member 14 having approximately a C-shaped form with a stop projection portion 14a. The hand member is formed with stop grooves 10a on its outer surface corresponding to the stop projection portion 14a of the stop member 14 of the forearm member 3b. When the forearm member 3b is moved along the hand member 10, the stop projection portion 14a of the stop member 14 of the forearm member 3b is engaged with the stop groove 10a of the hand member 10, thereby holding the forearm member 3b onto the hand member 10. An upper piece member 15 is pivotally mounted on the upper part of the upper arm member 3a. The upper piece member 15 and the forearm member 3b are each provided with disc members 16. The arm members 3 are pivotally mounted through crank coupling member 20 to both sides of the base member 2 constituting the trunk portion of the robotic humanoid form. As shown in FIGS. 3a and 3b, the crank coupling member 20 comprises a support member 21 and two pivot shafts 22 and 23 on the opposite sides of its opposite end portions, and the pivot shaft 22 is formed with a stopper portion 22a on its free end. The pivot shaft 23 is provided with a circular stop member 24 having grooves 24a via screws 25 on its free end. The pivot shaft 23 is formed with a through-hole 23a leading to a through-hole 26 formed in the support member 21. In the through-holes 23a and 26, a stop stick member 28 and a resilient member 27 such as a coil spring are arranged so that the free end of the stop stick member 28 biased by the resilient member 27 may project to the base member 2 beyond the inner surface of the support member 21. The base member is formed with stop grooves 18 so as to engage with the projected free end of the stop stick member 28.

As shown in FIG. 3b, the pivot shaft 22 of the crank coupling member 20 is pivotally supported by a bearing member 2a formed on the base member 2. The upper arm member 3a is provided with a bearing portion 17 therein having a through-hole 17a through which the pivot shaft 23 of the coupling member 20 is inserted, and a flexible stop member 29 having a stop projection 29a on its free end is mounted to the bearing portion 17 of the upper arm member 3a so that the stop projection 29a of the stop member 29 may engage with one of the grooves 24a of the circular stop member 24 of the pivot shaft 23. Hence, the arm member 3 may be click-pivoted with reference to the crank coupling member 20. The circular stop member 24 secured to the free end of the pivot shaft 23 prevents the pivot shaft 23 inserted in the through-hole 17a of the bearing portion 17 from falling out of the upper arm member 3a.

Figure 4A:
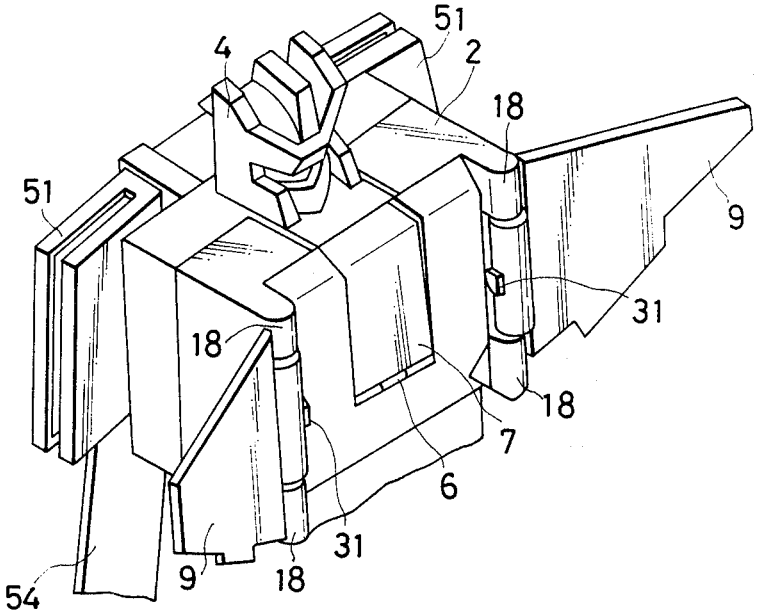
FIG. 4*a* and FIG. 4*b* are fragmentary perspective views for explaining front wing members pivotally mounted to the base member of the robotic humanoid form.
Figure 4B:
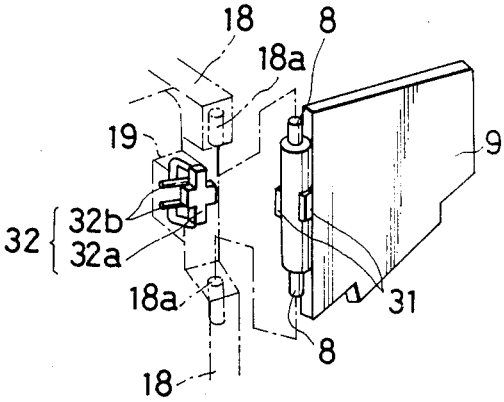

As shown in FIGS. 4a and 4b, each front wing member 9 is provided with a pair of pivot shafts 8 on the upper and lower parts of its pivot end and with a pair of engaging projections 31 on the central portion of the pivot end. The base member 2 is formed with pairs of bearing portions 18 each having an engaging hole 18a on its front upper left and right sides. The pivot shafts 8 of the front wing members 9 are inserted in the engaging holes 18a of the bearing portions 18 of the base member 2. The base member 2 is also formed with a pair of engaging grooves 19 in the middle of the bearing portions 18, and in each engaging groove 19 a flexible member 32 corresponding to the engaging projections 31 of the front wing member 9 is held. The flexible member 32 comprises a contact member 32a and a pair of flexible bodies 32b, each having approximately a L-shaped form, connected to the contact member 32a. The contact member 32a of the flexible member 32 always contacts with the engaging projection 31 of the front wing member 9 at its pivot end so that the contact member 32a may securely hold the front wing member 9 even when the front wing member 9 is extended or folded.

Figure 5:
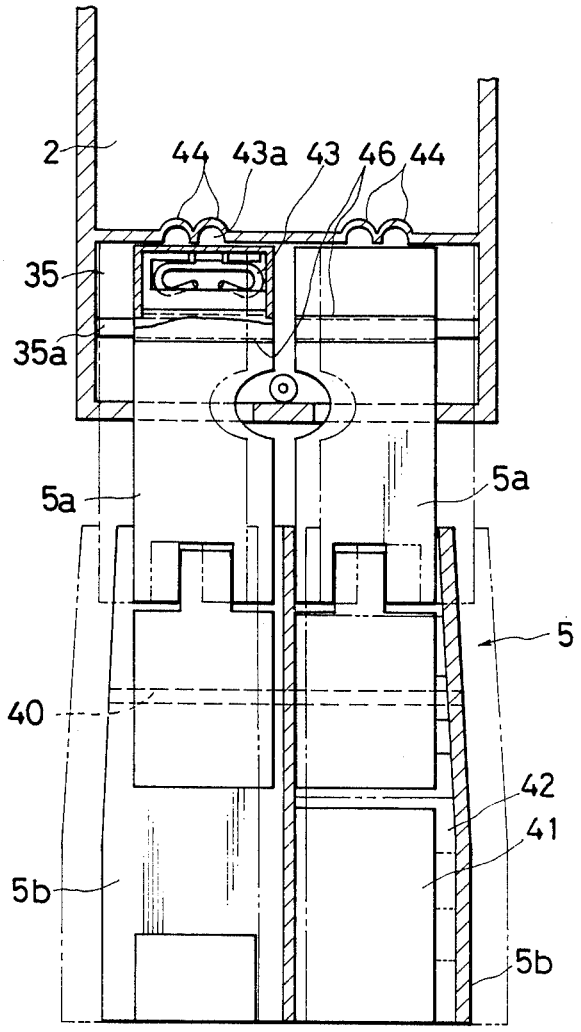
FIG. 5 is a fragmentary longitudinal cross sectional view of leg members and a base member for explaining the connection therebetween.

As shown in FIG. 5, each leg member 5 comprises a thigh member 5a and a lower leg member 5b which are pivotally connected to each other via a pivot shaft 40 so as to be collapsible. When the leg member 5 is folded by pivoting the lower leg member 5b onto the thigh member 5a, the thigh member 5a is contained within the lower leg member 5b and is covered by a cover member 42 which is pivotally mounted to the lower leg member 5b through a pivot shaft 41. Each thigh member 5a of the leg members 5 is provided with slider grooves 46 which are engaged with slider pieces 35a of an engaging portion 35 formed in the lower part of the base member 2. The thigh member 5a is formed with a flexible stop member 43 of approximately a C-shaped form, having an engaging projection 43a, in its upper part, and the engaging projection 43a of the flexible stop member 43 projects upwards beyond the upper end of the thigh member 5a. The engaging portion 35 of the base member 2 is formed with engaging grooves 44 on its upper surface, and the engaging projections 43a of the flexible stop members 43 of the thigh members 5a engage with the engaging grooves 44 of the engaging portion 35 of the base member 2. Accordingly, the slidable leg members 5 may be securely held to the base member 2. A pair of accessory members 45 are pivotally mounted to the outer upper parts of the lower leg members 5b of the leg members 5 through pivot shafts 45a, as shown in FIG. 1a.

Figure 2B:
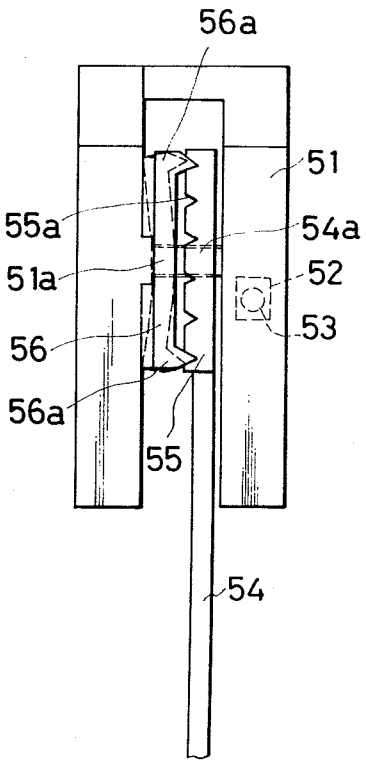
FIG. 2*b* is a fragmentary side view of a bracket and a rear wing of the robotic humanoid form.
Figure 2A:
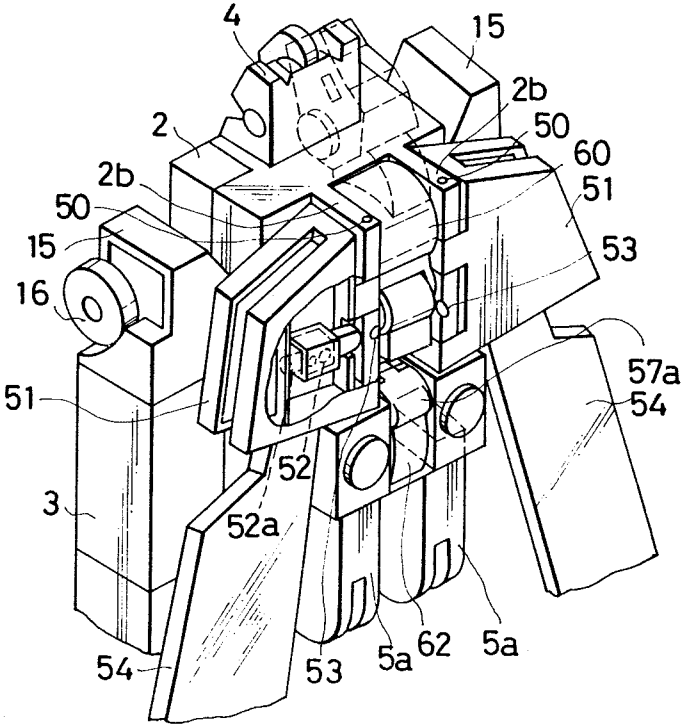
FIG. 2*a* is a perspective view of a robotic humanoid form of the reconfigurable toy assembly of FIG. 1, seen from the rear.

Then, as shown in FIG. 2a, the base member 2 is integrally provided with two vertical support members 2b on its rear central portion at a certain interval, and a pair of bifurcated bracket members 51 are pivotally mounted to the free ends of the support members 2b via pivot shafts 50. Within the bifurcated bracket member 51, an engaging member 52 and a resilient member 52a biasing the engaging member 52 towards the support member 2b beyond the surface of the bifurcated bracket member 51 are arranged, and the support member 2b is formed with an engaging groove 53 which engages with the projecting end of the engaging member 52 fitted in the bifurcated bracket member 51. Hence, when the bifurcated bracket member 51 is pivoted around the pivot shaft 50, the projecting end of the engaging member 52 engages with the engaging groove 53 of the support member 2b, thereby holding the pivot position of the bifurcated bracket member 51 with reference to the support member 2b. The bifurcated bracket members 51 may be preferably formed of two divided members since a pair of rear wing members 54 are pivotally mounted to the bifurcated bracket members 51, as hereinafter described in detail.

As shown in FIG. 2b, each rear wing member 54 is formed with a bearing hole 54a in its upper end portion and a circular engaging member 55 around the bearing hole 54a, and the circular engaging member 55 is formed with a plurality of grooves 55a on its periphery. The bracket member 51 is formed with a pivot shaft 51a on which a flexible engaging member 56 having a pair of engaging projections 56a on its upper and lower ends is secured. The rear wing member 54 is fitted on the pivot shaft 51a by inserting the pivot shaft 51a in the bearing hole 54a while the engaging projections 56a of the flexible engaging member 56 engage with the grooves 55a of the circular engaging member 55 of the rear wing member 54. Hence, when the rear wing member 54 is pivoted around the pivot shaft 51a, the engaging projections 56a of the flexible engaging member 56 are repeatedly disengaged from or engaged with the grooves 55a of the circular engaging member 55, and thus the rear wing member 54 may be click-pivoted with respect to the bifurcated bracket member 51.

As shown in FIG. 2a, a head member 60 for the puma form is pivotally mounted within a concave portion 57 (see FIG. 2c) between the support members 2b on the rear portion of the base member 2. When the head member 60 is pivoted upwards, as shown by the broken lines in FIG. 2a, it appears as the head of the puma form of the toy assembly.

Figure 2D:
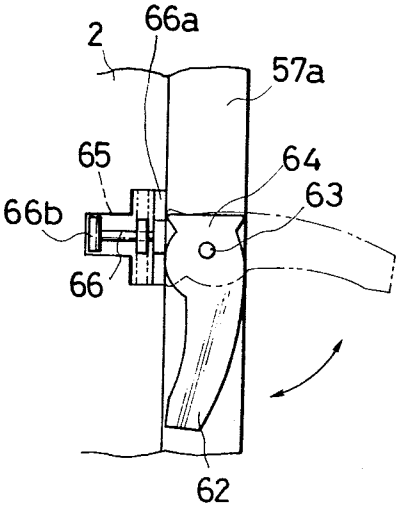
FIG. 2*c* and FIG. 2*d* show a trigger of a gun form pivotally mounted to a base member of the robotic humanoid form.
Figure 2C:
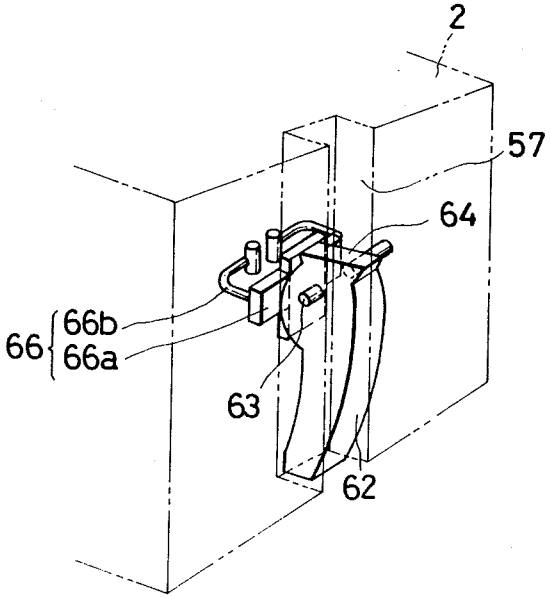

As shown in FIGS. 2c and 2d, in a concave portion 57a positioned under the concave portion 57 in which the head member 60 is pivotally mounted, a trigger member 62 for the gun form of the toy assembly is pivotally mounted to the base member 2 via a pivot shaft 63. The base end 64 of the trigger member 62 is flat. The base member 2 is formed with a hollow portion 65 corresponding to the trigger member 62 in the concave portion 57a, and a flexible member 66 comprising a contact member 66a and a pair of resilient members 66b having a L-shaped form is arranged in the hollow portion 65 so that the resilient members 66b may bias the contact member 66a onto the trigger member 62.

Figure 1B:
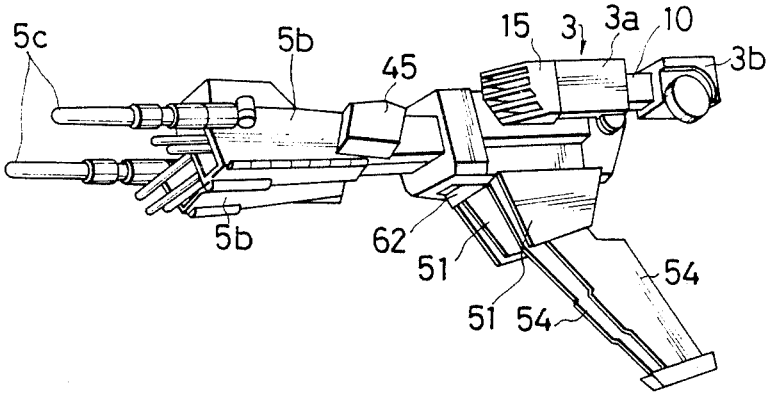

Now, the transformation operation of the reconfigurable toy assembly A from the robotic humanoid form to the puma form will be described as follows. First, the toy body 1 is configured to the robotic humanoid form, as shown in FIG. 1a. Next the robotic head member 4 is retracted into the base member 2, and the front wing members 9 are folded in front of the base member 2. Then, the arm members 3 are pivoted upwards 180° with reference to the base member 2, and the forearm members 3b are rotated 180° and extended upwards in order to cover the hand members 10 therein. Next, the leg members 5 are slid inwards close to each other, and the rear wing members 54 pivotally mounted to the respective bracket members 51 on the rear portion of the base member 2 are pivoted rearwards 45°. The free ends of the rear wing members 54 are brought into contact with each other. Then, a pair of particular members 5c representing muzzles are attached to the free ends of the lower leg members 5b, thereby obtaining the gun form, as shown in FIG. 1b.

In the gun form, the trigger member 62 is drawn out of the concave portion 57a. In this case, since the contact member 66a of the flexible member 66 is biased to the flat base end 64 of the trigger 62 by the resilient members 66b, when the trigger 62 is squeezed, the resilient members 66b push back the trigger 62 via the contact member 66a, and, when the squeezed trigger 62 is released, the trigger 62 is returned, resulting in a realistic simulation of actual gun operation.

Figure 1C:
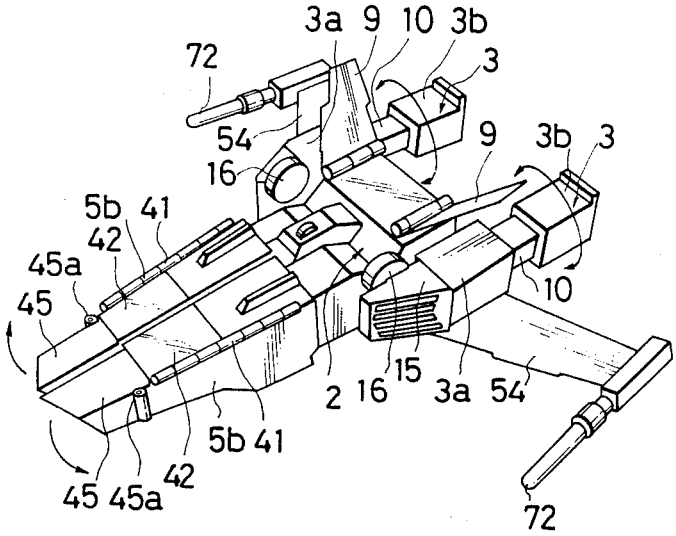

Next, the configuration of the toy assembly from the gun form into the jet plane form will be described. First, the forearm members 3b are rotated 90°, and the front wing members 9 are pivoted around the pivot shafts 8 so as to extend outwards. Then the rear wing members 54 are extended outwards 90° by pivoting the bracket members 51, and the lower leg members 5b are pivoted 180° around the pivot shafts 40 so that the thigh members 5a may be contained within the lower leg members 5b and be covered by the cover members 42. Then, the accessory members 45 are pivoted 180° around the pivot shafts 45a in order to close the ends of the lower leg members 5b, and a pair of gun accessory members 72 are attached to the front ends of the rear wing members 54, thereby forming the jet plane form, as shown in FIG. 1c.

Figure 1D:
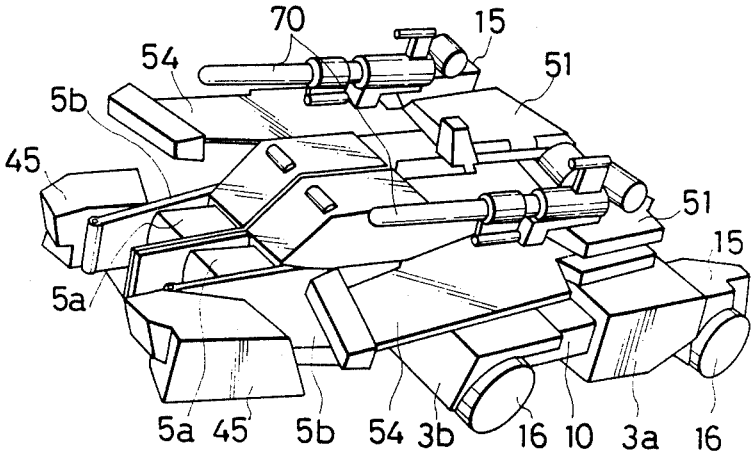

Next, the toy body having the jet plane form is turned upside down, and the gun accessory members 72 are detached from the rear wing members 54. Then, the rear wing members 54 are pivoted around the pivot shafts 51a 90° to the front, and the arm members 3 are vertically pivoted 180°. The forearm members 3 are rotated 90° and the piece members 15 are rotated 180°. Then, the accessory members 45 are pivoted 180°, and another pair of gun accessory members 70 are attached to the rear wing members 54, thereby obtaining the autombile form, as shown in FIG. 1d.

Figure 1E:
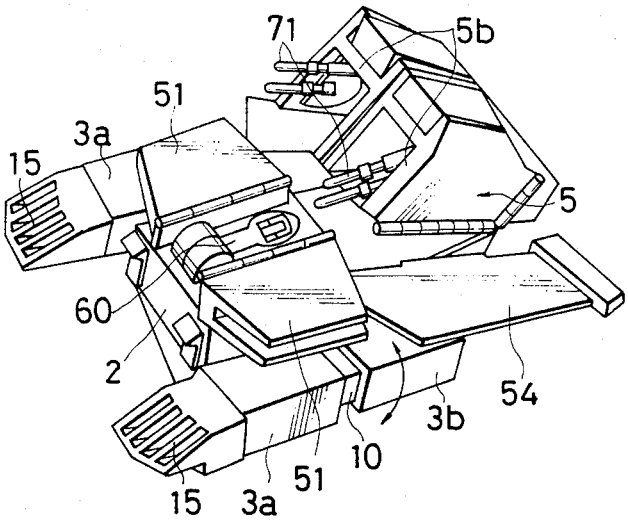

Then, the accessory members 45 are pivoted 45° and the forearm members 3b are rotated 180°. After opening the cover members 42, the lower leg members 5b are pivoted upwards approximately 45° around the pivot shafts 40, and gun attachments 71 contained in the lower leg members 5b are pivoted so as to appear, thereby transforming the automobile form into the armored car form, as shown in FIG. 1e.

Figure 1F:
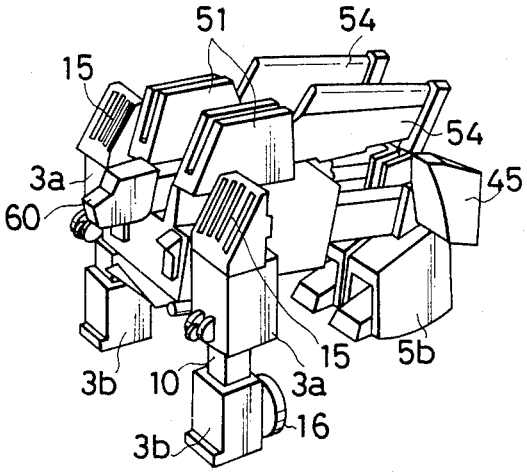

Finally, the lower leg members 5b are pivoted 270° around the pivot shafts 40, and the gun attachments 71 are withdrawn inside the lower leg members 5b. Then, the cover members 42 are closed. Next, the rear wing members 54 are raised by pivoting the bracket members 51 upwards 90° around the pivot shafts 51, and the arm members 3 are pivoted downwards 90° around the pivot shafts 23 of the crank coupling members 20. Then, the forearm members 3b are rotated 90°, and the accessory members 45 are pivoted 180°, thereby obtaining the puma form, as shown in FIG. 1f.

It is readily understood from the above description that according to the present invention there is provided a reconfigurable toy assembly which is capable of transforming into six different forms, and thus an operator can enjoy playing with this toy assembly not only because of the six different forms it can transform into, but also because of the actual transformation process itself. Further, when the toy assembly is configured into one of the six different forms, the components used only for the other forms may be contained within the insides of the other components, such as the trunk portion of the robotic humanoid form, and hence the hampering of the transformation process and marring of the external appearance of the toy assembly in any form by such components is overcome.

Further, according to the present invention, since the arm members are pivotally mounted to the base member via the crank coupling members, both ends of which are pivotally mounted to the two members, the pivoting range of the arm members with reference to the base member can be greatly extended compared with the conventional pivot coupling and further the pivoting coupling position between the arm members and the base member may be changed.

Although the present invention has been described with reference to a preferred embodiment thereof illustrated in the accompanying drawings, various changes and modifications can be made by those skilled in the art without departing from the spirit and the scope of the present invention.

What is claimed is:

1. A reconfigurable toy assembly which is capable of transforming into six different forms by changing the positions of movable toy components, comprising:

a base member constituting a trunk portion of a robotic humanoid form of the reconfigurable toy assembly;

a robotic head member pivotally mounted to the upper part of the base member so as to be retractable into the base member;

a pair of arm members of the robotic humanoid form, which are pivotally mounted to both the upper sides of the base member;

a pair of collapsible leg members of the robotic humanoid form, which are connected to the lower part of the base member, each leg member comprising a thigh member and a lower leg member which are pivotally connected to each other, and one member of which is contained within the other member and is covered by a cover member attached to the other member upon folding the leg member;

a pair of left and right front wing members of the robotic humanoid form are pivotally mounted to the front left and right side potions of the base member;

a pair of left and right bracket members which are pivotally mounted to the rear left and right side portions of the base member;

a pair of left and right rear wing members of the robotic humanoid form, which are pivotally mounted to the left and right bracket members;

a pair of left and right accessory members which are pivotally mounted to the left and right leg members;

a pair of left and right piece members which are rotatably mounted to the upper portions of the left and right arm members;

a pair of left and right hand members of the robotic humanoid form, which are rotatably mounted to the left and right arm members; and at least one head member of another form of the reconfigurable toy assembly, which is so mounted to the rear portion of the base member as to be retractable into the base member.

2. A reconfigurable toy assembly as defined in claim 1, wherein each arm member is pivotally mounted to the base member via a crank coupling member, one end of which is pivotally mounted to the arm member and the other end of which is pivotally mounted to the base member.

3. A reconfigurable toy assembly as defined in claim 1, wherein each arm member comprises an upper arm member and a forearm member which are so connected to each other via the hand member that the forearm member may be slidable along the hand member so as to cover the hand member completely.

4. A reconfigurable toy assembly as defined in claim 1, wherein the reconfigurable toy assembly is transformable into the robotic humanoid form, a gun form, a jet plane form, an automobile form, an armored car form and a puma form by changing the movable toy components.

5. A reconfigurable toy assembly as defined in claim 4, wherein, when the reconfigurable toy assembly is configured into the gun form, a trigger member is pivotally mounted to a lower portion of a magazine composed of the base member of the robotic humanoid form so as to be retractable into the magazine, and a flexible member biases the trigger member against a squeezing force on the trigger member.

* * * * *